United States Patent [19]

Hayman-Chaffey et al.

[11] 3,997,991

[45] Dec. 21, 1976

[54] DISPLAY DEVICE

[76] Inventors: Charles R. Hayman-Chaffey, 123 W. 74th St. Apt. 10B, New York, N.Y. 10023; Frederick W. Hayman-Chaffey, 239 Central Park West Apt. 12C, New York, N.Y. 10024

[22] Filed: July 18, 1975

[21] Appl. No.: 597,213

Related U.S. Application Data

[63] Continuation of Ser. No. 433,900, Jan. 16, 1974, abandoned.

[52] U.S. Cl. ..... 40/135; 40/132 R

[51] Int. Cl.[2] ..... G09F 13/04

[58] Field of Search ..... 40/135, 132 R, 130 R, 40/106.51, 106.52, 132 E

[56] References Cited

UNITED STATES PATENTS

| | | | |
|---|---|---|---|
| 518,806 | 4/1894 | Dillmann | 40/135 X |
| 1,282,829 | 10/1918 | Hernandez-Mejia | 96/88 X |
| 1,407,498 | 2/1922 | Sutphen | 40/106.51 X |
| 1,481,607 | 1/1924 | Hiscocks | 40/132 R |
| 3,163,554 | 12/1964 | Gessler | 40/135 X |
| 3,771,245 | 11/1973 | Mabrey et al. | 40/135 X |

*Primary Examiner*—John F. Pitrelli
*Attorney, Agent, or Firm*—Lane, Aitken, Dunner & Ziems

[57] ABSTRACT

A display device for decorative or advertising purposes capable of apparently converting a black and white image into a partially or entirely colored image when visible light is passed through a pair of adjacent translucent sheets. The first sheet contains an image which appears from an observation point forward of the first sheet as a black and white image in the absence of the visible light passing through the first sheet. The second translucent sheet located closely adjacent the first sheet contains at least a portion of the image on the first sheet and is at least partially colored so that when light passes through the pair of sheets, a colored image which is the optical combination of said first image and said second image is apparent from the observation point. In a preferred embodiment, the black and white sheet is made from a paper having photographic properties and is photographically negative. The second sheet is preferably photographically positive and is made from either a paper having photographic properties or from a transparent or translucent plastic material which may be manually colored or mechanically printed with translucent colored inks. In the alternative, the first sheet may be printed, for example, with translucent inks. The method of making the device is also disclosed.

5 Claims, 4 Drawing Figures

FIG. 1.
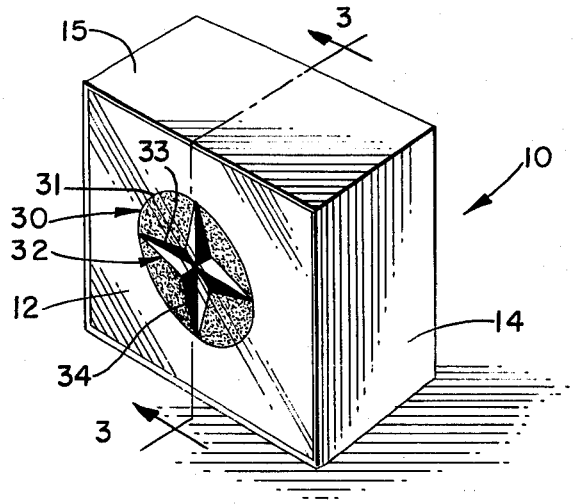
FIG. 2.
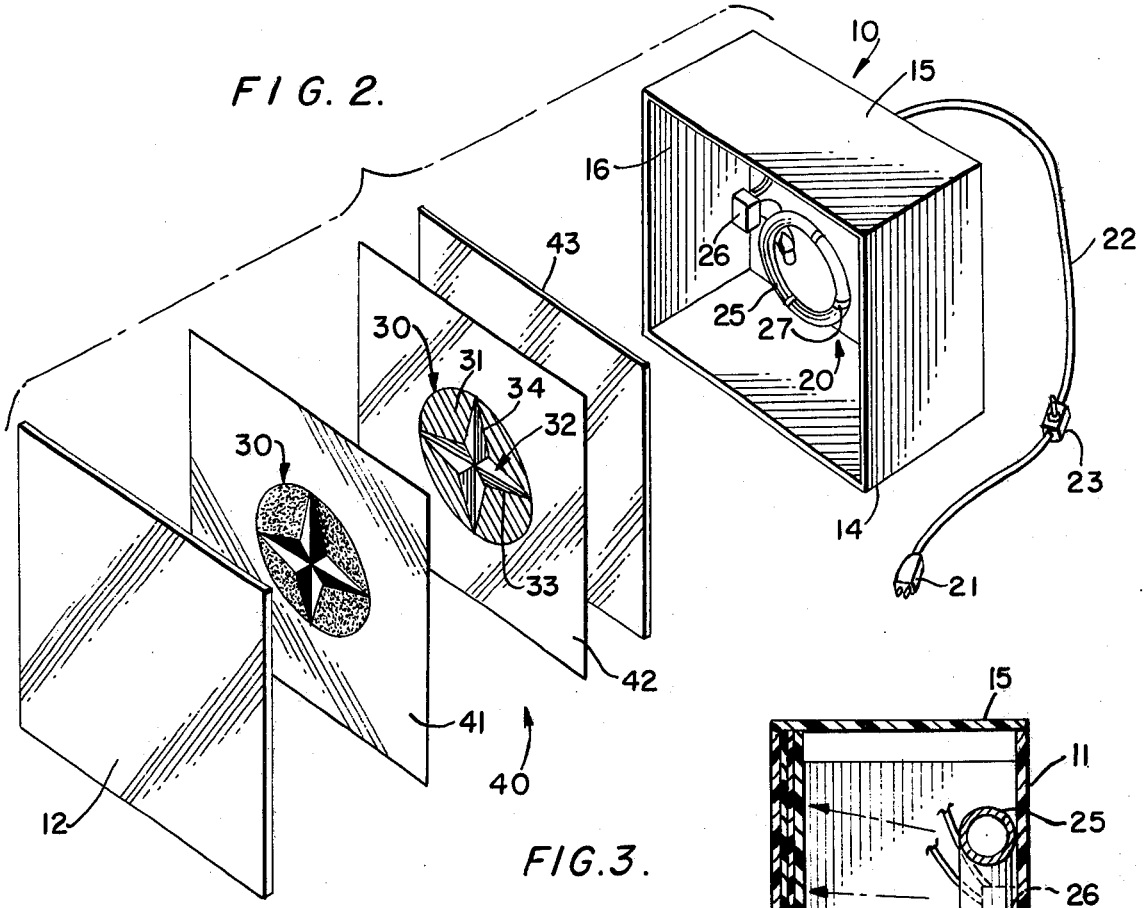
FIG. 3.
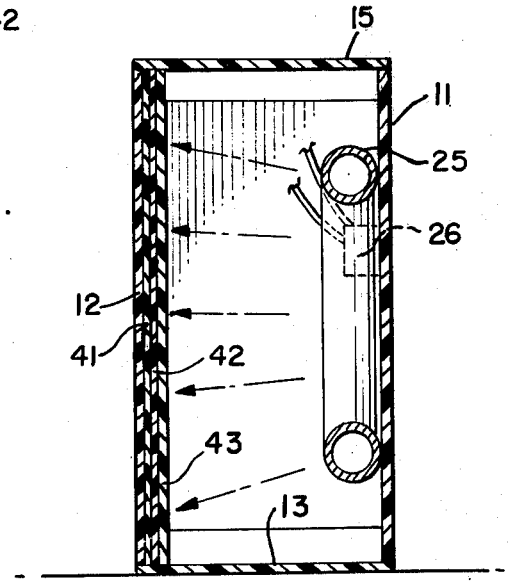
FIG. 4.
| | | | | |
|---|---|---|---|---|
| SHEET 41 | N | P | N | P |
| SHEET 42 | P | N | P/N | P/N |
| THIRD SHEET IF USED | | | N/P | N/P |
LIGHT

DISPLAY DEVICE

This is a continuation of application Ser. No. 433,900 filed Jan. 16, 1974, now abandoned.

BACKGROUND OF THE INVENTION

This invention relates to a display device having a visual image and a light source. Still more particularly, this invention relates to a display device which appears to an observer to transform by the addition of visible light a black and white image into at least a partially colored image.

In the visual display arts, a number of devices are available to attract the attention of an observer. In particular, a number of such devices have been developed for use in advertising displays or in point of purchase displays to portray an advertised product in an attractive light and to draw the attention of a potential purchaser to the displayed product. Some of these displays have utilized various types of light sources either in a reflected or in a projected fashion. While such devices have utilized black and white images, it has generally been found to be desirable to use colored images to display a product.

It is a principal aim of this invention to provide a display device of the general type described which appears to convert an image which appears to an observer as a black and white image into at least a partially colored image for advertising purposes. For purposes of this description, the use of the reference to "black and white" images is intended to refer to images which include black and white as well as gray in various tones since gray tones may be considered for these purposes to be combinations of black and white in various proportions.

It is an additional object of this invention to provide a lightweight portable aesthetically pleasing housing having a plurality of translucent or opaque walls and a transparent front wall for displaying the apparent black and white image.

It is an additional object of this invention to provide such a device which appears to the observer to convert the apparent black and white image into a colored image, for example, for advertising purposes.

It is an additional object of this invention to provide such a device having a first sheet of a material capable of passing visible light therethrough having an image which appears to an observer as a black and white image and a second sheet located closely adjacent to the first sheet and containing at least a portion of the first image which is at least partially colored so that upon the passage of visible light through the first and second sheets, the image to the observer appears to be colored in the manner that the second sheet is colored.

It is still another object of this invention to provide a device of the type immediately heretofore described in which material on the second sheet not otherwise apparent to the observer appears upon the application of visible light.

It is still another object of this invention to provide a method of making the device according to the invention.

These and other objects of this invention will become apparent from a review of the written description taken in conjunction with the accompanying drawings.

BRIEF SUMMARY OF THE INVENTION

Directed to achieving the aforestated objects and aims of this invention, the device according to the invention is capable of converting an apparent black and white image into a colored image upon the addition of visible light passing through the image. The device comprises a first sheet of material, for example, a translucent paper having photographic properties which is capable of passing visible light therethrough. The first sheet contains a first image which appears to an observer at an observation point forward of the front sheet as a black and white image in the absence of the application of visible light. In a preferred embodiment, the first sheet is photographically negative. In the alternative, the first sheet may be printed, for example, with translucent photographic inks.

A second sheet of translucent or transparent material such as paper or plastic, capable of passing visible light therethrough, is located closely adjacent the first sheet. The second sheet contains a second image which contains at least a portion of the first image, or all of the first image, thereon, which portion is at least partially colored other than black and white. The second sheet may contain additional indicia, for example, printed matter not apparent to the observer of the first sheet at the observation point in the absence of visible light passing through the sheets. The second sheet of material may be produced from paper having photographic properties which may be manually colored or from transparent or translucent plastic capable of having a colored image printed thereon. Moreover, the first sheet and the second sheet may be laminated or adhesively secured to one another by the use of a transparent adhesive.

The duplicate portion on the second sheet of the first image on the first sheet is positioned substantially in register with the corresponding portion of the first image on the first sheet. When visible light is caused to pass through both the first sheet and the second sheet, the image from the device which appears to the observer at the observation point appears to change from black and white to an image colored in accordance with the coloring on the second sheet and including whatever additional materials are disposed upon the second sheet. Thus, the apparent image when light is passed through the first sheet and the second sheet is the optical combination of the first image and the second image. Thus, such a device has attractive possibilities for use in advertising or point of purchase displays where the image on the second sheet emphasizes in a colorful manner such qualities or characteristics of the image on the first sheet and may also include local sources of supply or the like where the image is that of a product being advertised, for example.

Preferably, the first sheet is photographically negative and the second sheet is photographically positive. However, in such a circumstance, the second sheet may also be a combination of photographically positive and negative portions and the device may include a third sheet which has correspondingly photographically negative and positive portions relative to the second sheet to produce still other unique visual effects. Conversely, when the first sheet is photographically positive, the second sheet has preferably photographically negative and positive portions and may be still further backed by a third sheet which is correspondingly photographically positive and negative relative to the second sheet.

A housing comprising a plurality of walls which are translucent or opaque may be provided for housing the pair of sheets. The sheets are preferably disposed adjacent to a transparent front wall and a source of light is preferably located adjacent the rear wall for projecting the visible light through the sheets and through the transparent front wall.

The source of light may be a fluorescent light source or an incandescent light source, the latter being capable of being progressively illuminated or dimmed or programmed in a flashing or stroboscopic manner to further catch the eye of the observer.

Further attributes and features of the invention are explained in the written description of the invention which follows taken in conjunction with the accompanying drawings.

BRIEF DESCRIPTION OF THE DRAWINGS

In the drawings:

FIG. 1 is a perspective view of the display device according to the invention for converting an apparent black and white image to an image displaying at least some color by the passage of visible light through the translucent sheet elements containing the components of the image;

FIG. 2 is an exploded perspective view of the display device of FIG. 1 showing its component parts;

FIG. 3 is a side cross-sectional view taken along line 3—3 of FIG. 1; and

FIG. 4 is a chart relating the relative photographic positive or negative properties of the respective sheets which comprise a portion of the invention.

DETAILED DESCRIPTION OF THE PREFERRED EMBODIMENTS

In FIGS. 1-3, the display device according to the invention is designated generally by the reference numeral 10 and comprises a substantially closed rectangular structure. The display device 10 comprises a rear wall 11, a front wall 12, a bottom wall 13, a right side wall 14, a top wall 15 and a left side wall 16. Preferably, the walls 11–16 are manufactured from a suitable plastic material, such as that sold under the name "Lucite" or "Plexiglas", in a manner well known in the art and appropriately assembled, such as by fasteners or adhesive or a combination of both. The device 10 may also be constructed from other materials or in configurations other than rectangular and in any suitable size.

Preferably, the device 10 is constructed so that the rear wall 11 with electrical components attached thereto may be readily removable for servicing or for replacement of the electrical parts. In addition, it is preferred that the front wall be readily accessible, either by removal as a unit or together with the decorative display behind the front wall as will be hereinafter discussed or by the removal of the rear wall 11.

The walls of the display device 10 may be transparent, translucent, or opaque with the exception of the front wall 12 which is transparent so that images located behind the front wall may be seen. It is, however, preferred to utilize a plurality of opaque walls in combination with some translucent walls to mask the view of the interior of the display device from the viewer to avoid distracting his attention from the image displayed, and for aesthetic and decorative purposes.

A light source identified generally by the reference numeral 20 is secured to the rear wall 11. The light source 20 provides a source of visible light to pass through the image displayed behind the front wall 12 to change the apparent black and white image display to an image which is colored, or contains color with tones of gray. A plug 21 adapted for use with conventional sources of electricity connects to a cord 22 having an on/off switch 23 therein. The cord is provided to the interior of the light box 10 to provide power to a source of light, for example, a circular fluorescent tube 25 having conventional starter and ballast circuitry and transformers identified generally by the reference numeral 26 associated therewith. Suitable mechanical holders 27 are secured to the rear wall 11 for enveloping in part the fluorescent tube.

As previously indicated, it is a significant feature of the invention to change an apparent black and white image to a color image or to an image having color with a gray background with the addition of white light from a source such as the fluorescent tube 25. Accordingly, for purposes of discussion, a representative image 30, having a background field 31 and a faceted star design 32 superimposed thereon has been shown in the various views for purposes of illustration.

The selection of the displayed image is a matter of choice, however, as long as the image is prepared according to the teachings of this invention. In addition, the drawing is lined for color for representative purposes as will be discussed.

The components of the central portion of the light box arrangement are indicated generally by the reference numeral 40 and comprise the front wall 12 which is transparent and may be made, for example, from a clear piece of acrylic, for example, of about one-eighth inch thickness, sold under the trade name "Plexiglas". A first sheet member 41, in contact with the front wall 12, contains a black and white image. This black and white image may be located on a thin sheet of translucent photographic paper having certain physical and photographic properties as will be explained or may be printed on a translucent or transparent sheet with appropriate inks. In any case, the first sheet is capable of passing visible light therethrough.

By way of example, a suitable photographic paper for use as the first sheet 41 according to the invention is available from Eastman-Kodak Company (hereafter "Kodak"), Rochester, New York, under the designation "KODAGRAPH CONTACT PAPER". Such contact paper is available in translucent, ultrathin, fine line, and lightweight stocks, of which the ultrathin paper (designated by the manufacturer as "CI" paper) has proved suitable for use. Such photographic contact paper is suggested by the manufacturer for use for making reproductions of engineering drawings, documents, printed or typewritten pages and coarse-dot halftone illustrations. The ultrathin contact paper (CI) may be used for negative and positive intermediates and has a high printback speed for making direct contact process prints.

In the illustration in FIG. 2, the image 30 on the photographic paper 41 is negative. It has been found that any type of original image can be employed from a continuous tone photograph to a high contrast image to produce the negative image on the "C1" contact paper or a positive image, if desired, on a suitable photographic paper. The image is directly recorded from a transparent color picture or a black and white positive picture and printed on the contact paper, developed, rinsed, fixed, washed and dried according to the manufacturer's instructions for the use of such paper.

For use with the ultrathin contact paper ("C1"), the print-through method is recommended, although a reflex printing method may also be used. By way of specific example, a contact printer with a vacuum or pressure type printing frame may be used to produce the sheet 41. Thereafter, the contact paper is developed in a suitable developer for specified times and at specified temperatures and the resulting prints rinsed in a suitable bath. Developers and rinsing baths (sometimes referred to as "stop baths") are available from Kodak and such baths are also prepared according to the manufacturer's instructions.

After rinsing, the print is fixed at a specified time and temperature in a suitable fixer, again prepared according to the manufacturer's instructions. After fixing, the prints are washed in running water at a specified temperature and dried to produce a visual image in black and white. The flow of water must be great enough to cause rapid agitation and good movement of the prints without a stream of water falling directly on the prints. Mechanical devices may be used to facilitate washing. The prints are dried by removing the excess water with a squeegee or a clean, soft, moist viscose sponge and disposed on a line to air dry. A belt dryer may also be used.

Another suitable projection paper which may be used to produce the black and white sheet 41 is also available from Kodak under the designation "KODAGRAPH PROJECTION PAPERS", with the model designations "P1" (ultrathin) or "P4" (lightweight), of which "P1" paper is preferred. For either the "C1" or "P1" papers or equivalent manual process papers, the manufacturer's instructions provide details to produce black and white reproductions suitable for use in practicing the invention.

In addition to the manual process papers described above, machine process papers available from Kodak under the designations "KP4", "Kp5", and "KPP5" may also be used to produce the black and white image 30 on the sheet 41.

A second sheet 42 is prepared containing the same image 30, or at least a portion of the image 30, as is on the sheet 41. The image 30 on the sheet 42 is colored, at least in part, for example, by printing by a four color technique or by manually coloring the image 30. In the particular instance of FIG. 2, since the image on the sheet 41 is negative, the coloring of the image on the sheet 42 is positive to achieve a desired third dimensional effect.

In any case, the inks or coloring agents used to color the sheet 42 are translucent to permit light to pass therethrough and may penetrate the sheet to any desired depth or disposed upon the surface of the sheet to any desired extent. Transparent inks may also be used.

The material of the thin sheet 42 may be, for example, mylar, polyethylene sheet, or acetate or other printing plastics which can be printed in color, as previously indicated, for example by a multi-color printing process. such a sheet is otherwise transparent or translucent. In the alternative, orthochromatic projection paper, such as that available from Kodak under the designations "FP1" or "PQ1", may also be used to produce the colored image on the sheet 42.

Other materials which can be used to produce either of the sheets 41 or 42 are available in the trade under the designations "VIVITE" and "CRONOPAQUE". The former is a plastic paper with characteristics similar to polyethylene, while the latter is a plastic print film, again with similar characteristics.

A transparent or translucent backing sheet 43, for example, paper or plastic, is used adjacent the sheet 42 to complete the display 40. It is advantageous to produce the front wall 12 and the sheets 41–43 as a unit, to facilitate changing the display in the display device 10. Alternatively, the sheets 41 and 42 may be replaced as a unit, if desired.

When the light 25 is off, the visual image seen by the observer through the clear transparent front wall 12 is a black and white image as is represented on the sheet 41. In the absence of light passing through the sheets 43, 42, 41 and 12, there is no awareness by the observer of the second image or color on the second sheet 42. When the light 25 is switched on, the color immediately appears to the observer, changing the black and white image to tones of gray and full color, or only full color if desired. Thus, the apparent visual image produced when the light source is on is the optical combination of the images on the first and second sheets.

The simple juxtaposition of negative and/or positive sheets also gives the observer the illusion of depth and perspective. Moreover, the undersheet 42 can contain other facts, such as written materials, not apparent to the observer when the light 25 is off, or other images besides an exact positive or negative of the upper negative or positive so that the other visual elements can be made to appear to the observer only when the light 25 is on. The intense black and white and gray tones on the image of the sheet 41 seen without the light by the observer precludes any idea or suggestion that the color or written message can be projected through the first sheet when the source of light is turned on.

Accordingly, the device has significant advantages in producing eye-catching displays, for demonstrating the effects of coloring a black and white image, advertising, sequential development of ideas, and a myriad of other advertising displays, informational displays, or the like. Still further, the device can be used to display works of art, or educational displays.

By way of specific example, for advertising purposes, the image 30 on the sheet 41 may be a consumer product available in a specific package design. The package design will thus be the image 30 on the sheet 41 and will be seen by the observer as a black and white package, in the absence of light passing through the sheet. The image on the sheet 42 is the same package design colored in the manufacturer's colors, or in an eye-catching color scheme. Upon the passage of the light through the sheets 42 and 41, the image seen by the observer will change immediately to the color image on the sheet 42. The sheet 42 may also include printed matter such as the name of the local dealer for the product advertised, which information will also only appear to the observer when the light 25 is on.

In the embodiment described in connection with FIG. 2, the sheet 41 contains the image which is photographically negative while the same colored image on sheet 42 is photographically positive. Various other combinations may be used. For example, the image on the sheet 41 may be positive, or the image on the sheet 42 may be negative. As still another possibility, the image on the sheet 41 may be negative, the image on the sheet 42 may be a combination of positive and negative, or the negative first sheet and the positive second sheet may be backed by still a third sheet which is negative or positive respectively. Conversely, for a positive image on sheet 41, the image on sheet 42 may be negative or a combination of positive or negative backed by a third sheet which is negative or positive respectively relative thereto. The choice of negative and positive combinations is a matter of choice depending on the desired effect. A third sheet (if used) is also translucent to permit passage of light therethrough.

FIG. 4 is a chart showing the various combinations of positive and negative sheets which may be used. As shown in that chart, if the sheet 41 is negative, the sheet 42 is preferably positive, but may also be a combination of positive and negative, or backed with a third sheet which is relatively negative or positive with respect to sheet 42. On the other hand, if the sheet 41 is positive, sheet 42 is preferably negative, but may also be a combination of negative and positive or backed with a third sheet which is relatively positive or negative with respect to sheet 42.

The light source 25 has been described as a fluorescent light source, but an incandescent light source may be used as well. Moreover, the electrical circuitry may contain additional provisions for dimming the incandescent light; fading the incandescent light; causing the light to flash, for example, at a rate to produce a subliminal effect; or for programming the flashing sequence of a plurality of light sources in a predetermined pattern.

The image 30 in FIGS. 1 and 2 is lined to demonstrate that the sheet 42 is colored. Thus, for illustrative purposes, the background 31 is lined as green, the portion of star design 32 designated by the reference numeral 33 is lined as blue, while the portion of the star design designated by the reference numeral 34 is lined as red.

The sheets 41 and 42 are preferably positioned closely adjacent one another with the respective images closely in register. The sheets 41 and 42 may be laminated together by a suitable laminating process, such as one involving transparent adhesive applied over the face of at least one of the sheets, or along an end or the edges thereof. The more closely adjacent the sheets are positioned, the sharper the image which will appear when the light 25 is on. On the other hand, the thickness of the sheets causes an illusion of depth or third dimension when the light is on, so that the relative thicknesses of the sheets may be chosen with this feature in mind.

Thus, a unique decorative display device has been disclosed having a number of unique capabilities for a wide variety of uses.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. A display device capable of converting an apparent black and white image into an apparent at least partially colored image when visible light is passed through said image, comprising:

a first sheet of a translucent material capable of passing visible light therethrough, said first sheet containing a first image which appears by reflected light from an observation point forward of said first sheet as a black and white image in the absence of visible light passing through said first image;

a second sheet of translucent material capable of passing visible light therethrough, said second sheet containing a second image which is not apparent at said observation point by reflected light in the absence of visible light passing through said second image which includes at least a portion which is the duplicate portion of said first image, said second image being positioned immediately adjacent to said first sheet without an intervening sheet therebetween so that the duplicate portion of said first image included in said second image is in register with the corresponding portion of said first image on said first sheet and wherein said first sheet and said second sheet are laminated or adhesively secured with transparent adhesive one to the other to form a sharp clear image when lighted and wherein said first sheet is a translucent sheet having photographic properties and wherein said second sheet is a translucent sheet having photographic properties, each adapted to have colored images applied thereto, wherein, said second sheet is a combination of photographically negative and photographically positive portions, the portion of the image on said second sheet which is in register with said first sheet being the photographic inverse of the image on said first sheet;

a source of visible light within said housing and at a rear portion thereof which is capable of passing visible light through both said first sheet and said second sheet;

a housing supporting said first and said second sheets at a front portion thereof and said light source at a rear portion thereof to project said visible light through said sheets, said housing further comprising a plurality of walls, said front wall being transparent, said first sheet being located adjacent said front wall;

whereupon, upon the passage of visible light through said first sheet and said second sheet, the optical combination of the second image on said second sheet including said partially colored portion and said first image on said first sheet is apparent at said observation point.

2. The device as set forth in claim 1 wherein said second image includes substantially entirely said first image.

3. The device as set forth in claim 1 wherein said second image includes a portion other than said first image.

4. The device as set forth in claim 1 wherein said first sheet is photographically positive.

5. The device as set forth in claim 1 wherein said first sheet is photographically positive and said second sheet is photographically negative.

* * * * *